US010881258B2

(12) United States Patent
Moser et al.

(10) Patent No.: US 10,881,258 B2
(45) Date of Patent: Jan. 5, 2021

(54) SURFACE CLEANING MACHINE AND METHOD FOR OPERATING A SURFACE CLEANING MACHINE

(71) Applicant: Alfred Kärcher GmbH & Co. KG, Winnenden (DE)

(72) Inventors: Fabian Moser, Schorndorf (DE); Manuel Schulze, Kornwestheim (DE); Christoph Rufenach, Korntal-Muenchingen (DE); Johanna Buchmann, Stuttgart (DE); Andreas Mueller, Oppenweiler (DE); Mathias Frisch, Backnang-Maubach (DE); Alexander Braendle, Gundelsheim (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 472 days.

(21) Appl. No.: 15/486,004

(22) Filed: Apr. 12, 2017

(65) Prior Publication Data

US 2017/0215678 A1 Aug. 3, 2017

Related U.S. Application Data

(63) Continuation of application No. PCT/EP2015/073116, filed on Oct. 7, 2015.

(30) Foreign Application Priority Data

Oct. 13, 2014 (DE) ..... 10 2014 114 813

(51) Int. Cl.
*A47L 11/30* (2006.01)
*A47L 11/202* (2006.01)
(Continued)

(52) U.S. Cl.
CPC ..... *A47L 11/302* (2013.01); *A47L 9/0411* (2013.01); *A47L 11/202* (2013.01);
(Continued)

(58) Field of Classification Search
CPC ..... A47L 11/302; A47L 11/4016; A47L 11/4027; A47L 11/4041; A47L 11/4044;
(Continued)

(56) References Cited

U.S. PATENT DOCUMENTS 1,436,420 A 11/1922 Weydell
4,136,420 A 1/1979 Cyphert et al.
(Continued)

FOREIGN PATENT DOCUMENTS

CA 2 411 936 11/2003
CH 607 578 9/1978
(Continued)

*Primary Examiner* — David Redding
(74) *Attorney, Agent, or Firm* — Womble Bond Dickinson (US) LLP

(57) ABSTRACT

A surface-cleaning machine is provided, including an appliance body on which a suction apparatus device is arranged, a cleaning head on which at least one cleaning roller is arranged and on which there is positioned at least one suction mouth, which is fluidically connected to the suction apparatus device and is associated with the at least one cleaning roller, and a drive device for driving the at least one cleaning roller in rotation, wherein a drive axis of a drive motor of the drive device and an axis of rotation of the at least one cleaning roller are oriented transversely and in particular perpendicularly with respect to one another.

23 Claims, 10 Drawing Sheets

(51) Int. Cl.
*A47L 9/04* (2006.01)
*A47L 11/40* (2006.01)

(52) U.S. Cl.
CPC ..... *A47L 11/4008* (2013.01); *A47L 11/4016* (2013.01); *A47L 11/4027* (2013.01); *A47L 11/4041* (2013.01); *A47L 11/4044* (2013.01); *A47L 11/4069* (2013.01); *A47L 11/4083* (2013.01)

(58) Field of Classification Search
CPC ... A47L 11/4069; A47L 11/4083; A47L 11/40
See application file for complete search history.

(56) References Cited

U.S. PATENT DOCUMENTS

| | | | |
|---|---|---|---|
| 4,173,054 | A | 11/1979 | Ando |
| 4,668,256 | A | 5/1987 | Billiet et al. |
| 4,908,898 | A | 3/1990 | Kubo |
| 5,086,539 | A | 2/1992 | Rench |
| 5,350,432 | A | 9/1994 | Lee |
| 5,657,504 | A | 8/1997 | Khoury |
| 6,026,529 | A | 2/2000 | Caruso |
| 6,400,048 | B1 | 6/2002 | Nishimura et al. |
| 6,475,256 | B2 | 11/2002 | Matsubara et al. |
| 6,662,402 | B2 | 12/2003 | Giddings et al. |
| 6,735,812 | B2 | 5/2004 | Hekman |
| 7,022,003 | B1 | 4/2006 | Hughes |
| 7,128,770 | B2 | 10/2006 | Oh et al. |
| 7,150,068 | B1 | 12/2006 | Ragner |
| 7,272,870 | B2 | 9/2007 | Pierce et al. |
| 7,341,611 | B2 | 3/2008 | Greene et al. |
| 7,559,963 | B2 | 7/2009 | Oh et al. |
| 7,665,174 | B2 | 2/2010 | Basham |
| 7,921,497 | B2 | 4/2011 | Cook et al. |
| 7,967,914 | B2 | 6/2011 | Giddings et al. |
| 7,979,952 | B2 * | 7/2011 | Beskow ..... A47L 9/04 15/322 |
| 8,016,996 | B2 | 9/2011 | Field et al. |
| 8,025,786 | B2 | 9/2011 | Field et al. |
| 8,230,549 | B2 | 7/2012 | Lenkiewicz et al. |
| 9,289,105 | B2 | 3/2016 | Moes |
| 9,999,332 | B2 | 6/2018 | Braendle et al. |
| 2002/0194692 | A1 | 12/2002 | Giddings et al. |
| 2003/0159232 | A1 | 8/2003 | Hekman et al. |
| 2005/0160553 | A1 | 7/2005 | Gregory |
| 2005/0262659 | A1 | 12/2005 | Roschi et al. |
| 2009/0089967 | A1 | 4/2009 | Yang et al. |
| 2009/0119871 | A1 | 5/2009 | Dilger et al. |
| 2010/0132150 | A1 | 6/2010 | Egler et al. |
| 2010/0236010 | A1 | 9/2010 | Johnson |
| 2012/0066861 | A1 | 3/2012 | Louis et al. |
| 2012/0222244 | A1 | 9/2012 | Conrad |
| 2013/0091663 | A1 | 4/2013 | Mersmann |
| 2013/0219641 | A1 | 8/2013 | Guijarro |
| 2014/0000060 | A1 | 1/2014 | Demirtas et al. |
| 2014/0150984 | A1 | 6/2014 | Nishikawa et al. |
| 2014/0182079 | A1 | 7/2014 | Van Der Kooi et al. |
| 2015/0082579 | A1 | 3/2015 | Lin |
| 2016/0270613 | A1 | 9/2016 | Demirtas et al. |
| 2016/0278597 | A1 | 9/2016 | Braendle et al. |
| 2017/0215676 | A1 | 8/2017 | Moser et al. |
| 2017/0215677 | A1 | 8/2017 | Moser et al. |
| 2017/0215679 | A1 | 8/2017 | Moser et al. |
| 2017/0215681 | A1 | 8/2017 | Moser et al. |
| 2018/0228331 | A1 | 8/2018 | Moser et al. |
| 2018/0248977 | A1 | 9/2018 | Blum et al. |

FOREIGN PATENT DOCUMENTS

| | | |
|---|---|---|
| CN | 2109165 | 7/1992 |
| CN | 2174947 | 8/1994 |
| CN | 2266377 | 11/1997 |
| CN | 2675734 | 2/2005 |
| CN | 1718149 | 1/2006 |
| CN | 2845698 Y | 12/2006 |
| CN | 201158807 | 12/2008 |
| CN | 201384462 | 1/2010 |
| CN | 201930938 | 8/2011 |
| CN | 202151938 | 2/2012 |
| CN | 102493381 | 6/2012 |
| CN | 202313126 | 7/2012 |
| CN | 203346836 | 12/2013 |
| CN | 103690112 | 4/2014 |
| DE | 294 642 | 10/1991 |
| DE | 41 17 957 | 12/1992 |
| DE | 102 42 257 | 4/2003 |
| DE | 10 2004 013 262 | 9/2005 |
| DE | 10 2007 031 371 | 1/2009 |
| DE | 10 2008 013 485 | 11/2009 |
| EP | 0 012 337 | 6/1980 |
| EP | 0 186 005 | 7/1986 |
| EP | 0 844 843 | 7/2002 |
| EP | 1 535 560 | 1/2005 |
| EP | 1 465 518 | 4/2005 |
| EP | 1 736 089 | 12/2006 |
| EP | 1994868 | 11/2008 |
| EP | 2 177 128 | 4/2010 |
| EP | 2 387 932 | 11/2011 |
| EP | 2 641 524 | 9/2013 |
| EP | 2 721 988 | 4/2014 |
| FR | 2 797 895 | 3/2001 |
| GB | 1123052 | 8/1968 |
| GB | 2 341 124 | 3/2000 |
| GB | 2 411 823 | 9/2005 |
| GB | 2 420 967 | 6/2006 |
| GB | 2 435 820 | 9/2007 |
| JP | 2000342495 | 12/2000 |
| JP | 2001037695 | 2/2001 |
| JP | 2005-211350 | 8/2005 |
| JP | 2013081829 | 5/2013 |
| WO | WO 84/04663 | 12/1984 |
| WO | WO 90/14787 | 12/1990 |
| WO | WO 97/06721 | 2/1997 |
| WO | WO 00/78198 | 12/2000 |
| WO | WO 01/037716 | 5/2001 |
| WO | WO 02/28251 | 4/2002 |
| WO | WO 02/069775 | 9/2002 |
| WO | WO2005/089614 | 9/2005 |
| WO | WO 2005/096907 | 10/2005 |
| WO | WO 2006/102147 | 9/2006 |
| WO | WO 2006/110459 | 10/2006 |
| WO | WO 2010/041185 | 4/2010 |
| WO | WO 2010/140967 | 12/2010 |
| WO | WO 2013/027140 | 2/2013 |
| WO | WO 2013/027164 | 2/2013 |
| WO | WO 2013/106762 | 7/2013 |

* cited by examiner

SURFACE CLEANING MACHINE AND METHOD FOR OPERATING A SURFACE CLEANING MACHINE

CROSS-REFERENCE TO RELATED APPLICATIONS

This application is a continuation of international application number PCT/EP2015/073116 filed on Oct. 7, 2015 and claims the benefit of German application number 10 2014 114 813.4 filed on Oct. 13, 2014, which are incorporated herein by reference in their entirety and for all purposes.

BACKGROUND OF THE INVENTION

The invention relates to a surface-cleaning machine, comprising an appliance body on which a suction apparatus device is arranged, a cleaning head on which at least one cleaning roller is arranged and on which there is positioned at least one suction mouth, which is fluidically connected to the suction apparatus device and is associated with the at least one cleaning roller, and a drive device for driving the at least one cleaning roller in rotation.

The invention further relates to a method for operating a corresponding surface-cleaning machine.

WO 2013/027140 A1 has disclosed a cleaning apparatus for cleaning a surface, which cleaning apparatus has a rotatable brush. A rubber wiper element is also provided which is spaced apart from the brush and which is fastened to an underside of a nozzle housing.

WO 2013/027164 A1 or US 2014/0182079 A1 has likewise disclosed a cleaning apparatus with a rotatable brush and with a single rubber wiper element.

EP 2 177 128 A1 has disclosed an apparatus for distributing fluid on a brush.

DE 41 17 157 A1 has disclosed a method for cleaning or swabbing a preferably smooth surface, in which method the surface for cleaning is wiped by means of a substantially cloth-like wiping element, with the wiping element taking up dirt, and then the dirty wiping element is moistened and thereafter the dirt is removed from the wiping element by suction.

WO 2010/140967 A1 has disclosed a method for cleaning a dirty surface.

CH 607 578 has disclosed a brush apparatus which is connectable to a water line.

EP 0 186 005 A1 has disclosed a brush suction mouth piece equipped with running wheels.

FR 2 797 895 has disclosed a brush.

US 2002/0194692 A1 has disclosed a method for mechanically removing dirt from a surface.

DE 10 2011 053 667 A1 discloses an attachment unit for a vacuum cleaner, having a rotatable roller equipped with bristles or lamellar agitators. The axis of rotation of the roller extends transversely with respect to the forward movement direction of the attachment unit or vacuum cleaner. A motor is provided which rotates a motor shaft for the purposes of driving the roller. The motor shaft extends perpendicular to the axis of rotation of the roller.

DE 10 2004 013 262 A1 discloses a suction cleaning attachment for a vacuum cleaner.

DE 10 2007 031 371 A1 discloses a pair of brushes held in receiving devices.

SUMMARY OF THE INVENTION

In accordance with the present invention, a surface-cleaning machine is provided, which, while being of simple structural design, provides comprehensive cleaning capabilities.

In accordance with an embodiment of the invention, a drive axis of a drive motor of the drive device and an axis of rotation of the at least one cleaning roller are oriented transversely and in particular perpendicularly with respect to one another.

By means of a transverse orientation of the drive axis (axis of a motor shaft) and the axis of rotation, it is possible for the drive motor of the drive device to be arranged in space-saving fashion on the surface-cleaning machine. Said drive motor can in particular be arranged at a transition between the appliance body and the cleaning head. Said drive motor can thus be positioned low down on the appliance in order to realize a low center of gravity of the appliance as a whole. Said drive motor can in this case however also be positioned at least partially outside the cleaning head, such that said cleaning head can be designed to be of simple construction.

The drive motor can be installed transversely and thus positioned in a space-saving manner. This in turn makes the surface-cleaning machine easy to operate and handle.

Owing to the transverse orientation of the drive axis of the drive motor and of the axis of rotation of the at least one cleaning roller, the at least one cleaning roller can be positioned spaced apart from the drive motor. This yields a simple structural design on the cleaning head, and it is for example possible for the cleaning roller to be easily exchanged. Furthermore, the accumulation of dirt on the drive motor is reduced as a result of a spacing to the at least one cleaning roller.

A transmission device is provided for the transmission of the torque of the drive motor to the at least one cleaning roller. Said transmission device ensures an optimized circumferential speed of the at least one cleaning roller during cleaning operation. Furthermore, by means of a transmission device, a redirection of torque can be realized.

In one exemplary embodiment, the transmission device has a rotational speed reducer. The rotational speed reducer reduces a rotational speed provided by a shaft of the drive motor. For example, the rotational speed reducer serves to reduce the rotational speed from approximately 7000 revolutions per minute to approximately 400 revolutions per minute. It is thus possible for a standard drive motor (in particular electric motor) to be used.

In one exemplary embodiment, the rotational speed reducer is or comprises a planetary gearing. A planetary gearing can be of space-saving form. This yields optimized space utilization at the surface-cleaning machine.

The rotational speed reducer is in particular arranged at the drive motor, that is to say the rotational speed reducer and the drive motor are immediately adjacent to one another. In this way, a downstream angular gearing can be operated at the relatively low rotational speed output by the rotational speed reducer.

In particular, the transmission device comprises an angular gearing. In this way, it is possible to realize a redirection of torque in order to permit a different orientation of the drive axis and of the axis of rotation.

In one exemplary embodiment, the angular gearing comprises or is a bevel-wheel gearing. In this way, a transverse redirection can be realized in a simple manner.

In one exemplary embodiment, the transmission device furthermore comprises a belt which drives a drive element on which the at least one cleaning roller is (directly) seated. By means of a (at least one) belt, a space can be bridged for the purposes of torque transmission. This yields optimized space utilization. It is thus possible, for example, for an angular gearing to be arranged spaced apart from the at least one cleaning roller and to thus be positioned in protected and space-optimized fashion in the cleaning head. The transmission of torque from the angular gearing to the at least one cleaning roller is then realized in "bridging" fashion by means of the belt.

In accordance with an embodiment of the invention, the cleaning head is seated by means of a joint, so as to be pivotable about a pivot axis, on the appliance body.

By means of the joint, a pivoting position of the appliance body relative to the cleaning head can be varied. In this way, during a cleaning process, it is possible to use the at least one cleaning roller, which is driven in rotation, to perform cleaning even in otherwise inaccessible regions such as for example corner regions and edge regions.

The pivotability may constitute full rotatability, or a limited pivoting range of for example ±90° may be realized. A limitation of the pivoting range yields a simplified structural design with regard to guidance of lines from the appliance body to the cleaning head, because then lines do not need to be subjected to full rotatability.

Preferably, the pivot axis is oriented transversely with respect to a longitudinal axis of the appliance body, and in particular is oriented at an acute angle with respect to the longitudinal axis of the appliance body. The acute angle lies for example in the range between 20° and 30°, and is for example approximately 25°.

It is expedient if the drive motor of the drive device is positioned at least partially on the joint. In this way, the surface-cleaning machine can be formed in a structurally simple manner in particular as a floor-cleaning machine (for cleaning hard floors). It is basically expedient if the drive device with a heavy drive motor (in particular electric motor) is positioned as low down as possible on the surface-cleaning machine in relation to the direction of gravitational force. Positioning on the cleaning head basically increases the space requirement for the cleaning head. By way of the solution according to the invention, it is at least partially the case that the space at the joint is utilized for accommodating the drive motor of the drive device. In this way, the drive motor can be positioned low down in relation to the direction of gravitational force (close to the cleaning head), with optimum utilization of the available space. In particular, it is then also possible for the appliance body to be utilized for fixing the drive motor.

Then, the drive axis of the drive motor (the axis of a motor shaft of the drive motor) expediently lies at least approximately parallel or coaxially with respect to the pivot axis. This yields a simple structural design.

In particular, it can thereby be achieved that the cleaning head is mounted so as to be pivotable about the drive motor. This yields comprehensive cleaning capabilities with a simple structural design.

In one exemplary embodiment, the joint has an inner sleeve, in which the drive motor is at least partially positioned, and an outer sleeve, which is seated on the inner sleeve and which is mounted rotatably (pivotably) thereon. In this way, a joint can be formed in a simple manner. At the same time, the inner sleeve forms a type of motor housing for the drive motor. The surface-cleaning machine can thus be realized with optimum space utilization.

The outer sleeve is fixed either to the appliance body or to the cleaning head, and correspondingly, the associated inner sleeve is fixed either to the cleaning head or to the appliance body. In this way, the drive motor can be positioned, and can form the joint, in a simple manner. Here, the outer sleeve is advantageously fixed to the appliance body. The heavy drive motor is then fixed to the appliance body.

In one exemplary embodiment, the cleaning head has a first face side and an oppositely situated second face side, wherein, in a central region between the first face side and the second face side, there is arranged a drive element which is connected in terms of torque transmission to the drive device. Said drive element is driven.

In one embodiment, the at least one cleaning roller is of two-part form with a first part, which is seated on the drive element and is directed toward the first face side, and with a second part, which is seated on the drive element and is directed toward the second face side. In the case of this construction, the cleaning head can be formed in a structurally simple manner. It is for example possible for a belt for torque transmission to be positioned in the central region. With a space-saving design, it can be achieved that a cleaning effect is realized even at edge regions of the at least one cleaning roller (in the face regions). An uncleaned strip that possibly remains in a central region can be cleaned by being passed over in an offset manner. It is possible in particular for a divider to be arranged on the cleaning head, which divider distributes dirt/dirty liquid to the left and to the right for the purposes of feeding it to the first part and to the second part of the cleaning roller.

In one exemplary embodiment, a wetting device is provided for moistening the at least one cleaning roller with cleaning liquid. By means of said wetting device, it is possible for the at least one cleaning roller to be directly moistened with cleaning liquid (water or a mixture of water and detergent). This thus yields an optimized cleaning effect. Dirt on the surface for cleaning is softened by the liquid in the at least one cleaning roller and can thus be more effectively detached and carried away.

In one exemplary embodiment, a reservoir device for cleaning liquid is arranged on the appliance body. By means of cleaning liquid from the reservoir device, the wetting device can provide cleaning liquid to the at least one cleaning roller. This thus yields autonomous operation of the surface-cleaning machine for as long as cleaning liquid is still present in the reservoir device.

It may also be provided that a receiving device for dirt and/or a reservoir device for dirty liquid is arranged on the appliance body.

It is furthermore expedient if a separator device which is associated with the suction apparatus device is arranged on the appliance body. By means of the separator device, liquid can be separated off from dirty fluid that is sucked in. In this way, the suction apparatus device can be correspondingly protected.

During cleaning operation, the surface-cleaning machine is preferably supported on a surface for cleaning only by way of the at least one cleaning roller and in particular only by way of a single cleaning roller. By changing the angular orientation of the appliance body (with regard to its longitudinal axis) relative to the surface for cleaning, the overall height above the surface for cleaning can be varied. In this way, firstly, easy adaptation to a physical size of an operator is possible. Furthermore, by being lowered down (to a correspondingly low overall height), the surface-cleaning machine, with the at least one cleaning roller, can be moved for example under an item of furniture in order to perform cleaning under said item of furniture. Owing to the support on the surface for cleaning being realized via in particular a single cleaning roller, a form of pivotability of the surface-cleaning machine as a whole relative to the surface for cleaning is realized, wherein an associated pivot axis is the region of contact of the at least one cleaning roller on the surface for cleaning.

It is expedient if the at least one cleaning roller is driven at a circumferential speed in the range between 0.9 m/s (inclusive) and 1.2 m/s (inclusive), and is driven in particular at a circumferential speed greater than or equal to 0.92 m/s, and is driven in particular at a circumferential speed of at most 1.15 m/s. Said circumferential speed is basically settable. In particular, it is fixedly set by means of the design of the drive device (combination of a drive motor with a transmission device). It has been found that a minimum circumferential speed should be provided, because otherwise the cleaning roller merely rolls without imparting a sufficient cleaning effect. Furthermore, the circumferential speed should have a maximum rotational speed, because otherwise excessive spraying of liquid occurs. The at least one cleaning roller has a jacket such as for example a nonwoven fabric. The circumferential speed relates to the circumference of the at least one cleaning roller with compressed jacket as an effective diameter of the at least one cleaning roller.

It has proven to be expedient if the at least one cleaning roller is driven at a circumferential speed in the range between 0.95 m/s (inclusive) and 1.05 m/s (inclusive).

In the case of the method mentioned in the introduction for operating a surface-cleaning machine, it is provided according to the invention that the at least one cleaning roller is driven at a circumferential speed in the range between 0.9 m/s (inclusive) and 1.2 m/s (inclusive), and is driven in particular at a circumferential speed greater than or equal to 0.92 m/s, and is driven in particular at a circumferential speed of at most 1.15 m/s.

The method according to the invention has the advantages already discussed above in conjunction with the surface-cleaning machine according to the invention.

Here, if the at least one cleaning machine has a compressible jacket, the circumferential speed relates to an effective diameter of the at least one cleaning roller with the corresponding jacket in a compressed state.

In the stated range of circumferential speeds, an optimized cleaning effect is achieved. A situation is prevented in which the at least one cleaning roller merely rolls along. Furthermore, spraying of liquid is prevented.

It is expedient in particular if the at least one cleaning roller is driven at a circumferential speed in the range between 0.95 m/s and 1.05 m/s.

The suitable circumferential speed is basically dependent on a working speed of an operator, that is to say on the speed with which the operator pushes the surface-cleaning machine over a surface for cleaning. The stated data for the circumferential speed assume that said working speed of the operator is approximately 0.90 m/s.

The following description of preferred exemplary embodiments serves, in conjunction with the drawings, to explain the invention in more detail.

DETAILED DESCRIPTION OF THE INVENTION

Figure 1:
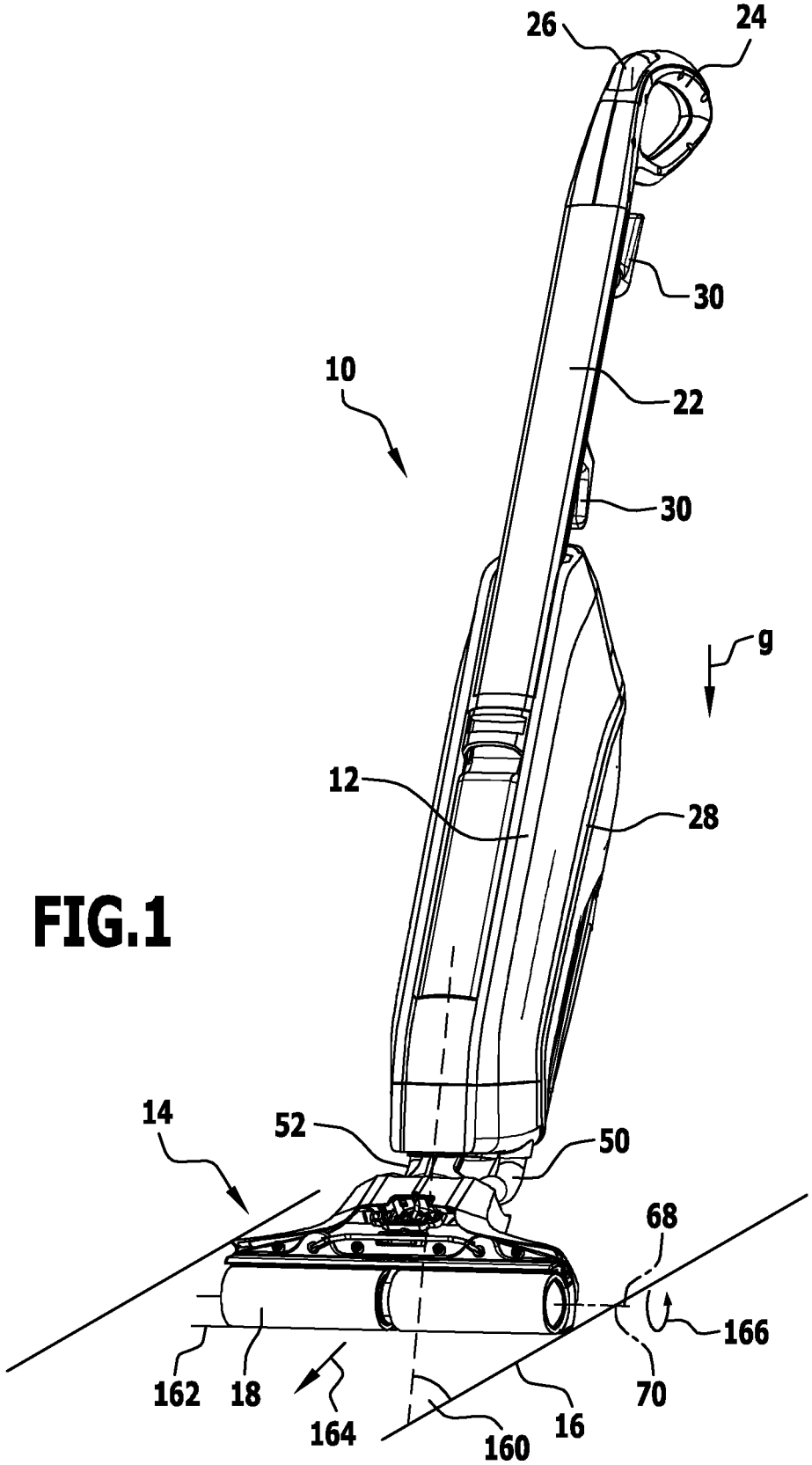
FIG. 1 is a perspective illustration of an exemplary embodiment of a surface-cleaning machine according to the invention.

An exemplary embodiment of a surface-cleaning machine according to the invention, which is shown in FIGS. 1 to 4 (and partially illustrated in FIGS. 5 to 10) and is denoted therein by 10, is in the form of a floor-cleaning machine for hard floors.

The surface-cleaning machine 10 comprises an appliance body 10 and a cleaning head 14. The cleaning head 14 is arranged on the appliance body 12.

During a cleaning process on a surface for cleaning 16, the surface-cleaning machine 16 is supported by means of a cleaning roller 18 on the surface for cleaning 16.

Figure 2:
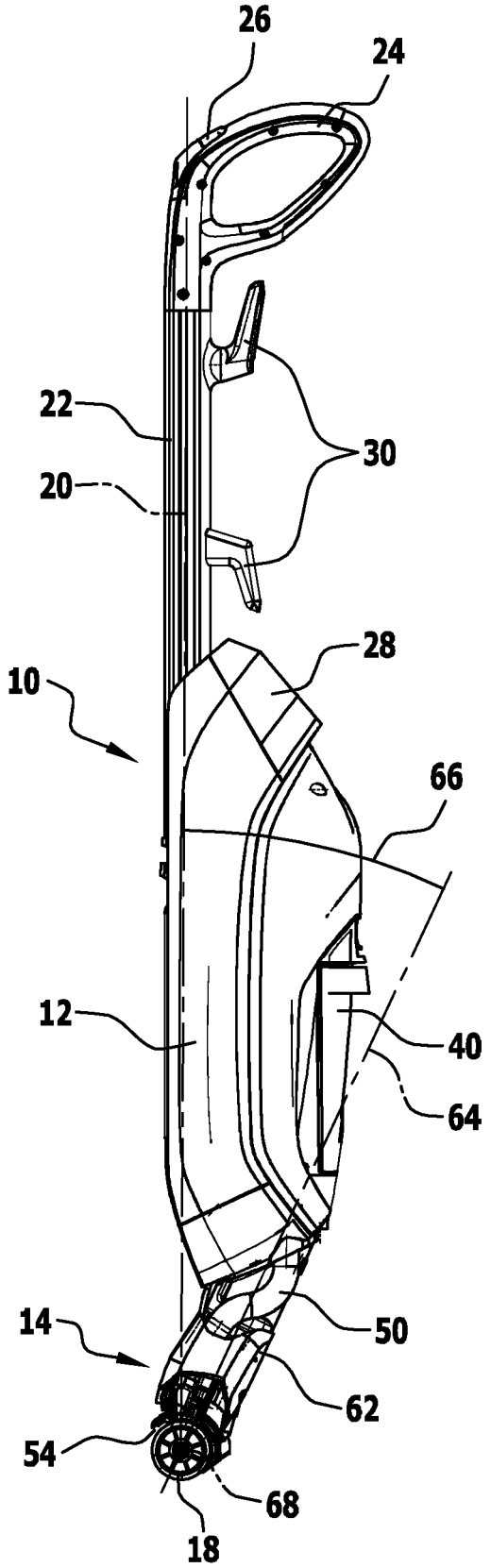
FIG. 2 shows a side view of the surface-cleaning machine as per FIG. 1.
Figure 3:
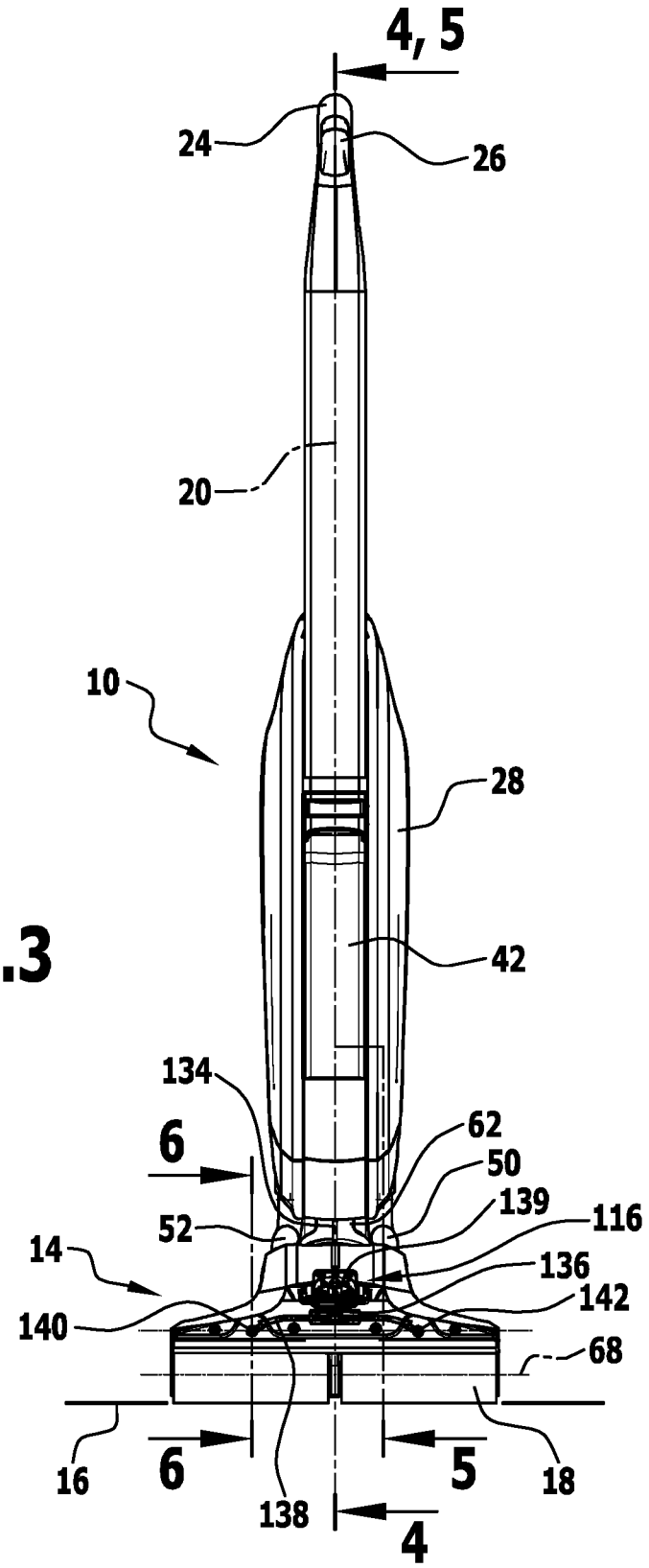
FIG. 3 shows a front view of the surface-cleaning machine as per FIG. 1.

The appliance body 12 has a longitudinal axis 20 (FIGS. 2 and 3). The surface-cleaning machine 10 is held by a shaft. For this purpose, a rod 22 is seated on the appliance body 12. Said rod 22 extends in the longitudinal axis 20. A handle, and in particular a stirrup-shaped handle 24, is arranged on an upper region of the rod 22. An operator can hold the surface-cleaning machine 10 using one hand on said handle 24.

One or more operating elements are arranged on the handle 24. In particular, a switch 26 is arranged on the handle 24. By means of the switch 26, the surface-cleaning machine 10 can be switched on for cleaning operation and switched off.

In particular, the control of the surface-cleaning machine 10 is such that actuation of the switch 26 causes all of the components required for the functioning (generation of a suction flow by means of a suction apparatus device, rotation of the cleaning roller 18, moistening of the cleaning roller 18) to be actuated, and correspondingly, a switching-off action at the switch 26 effects a synchronous switch-off of the actuation of said components.

The rod 22 may be height-adjustable (along the longitudinal axis 20) or arranged fixedly on the appliance body 12.

The appliance body 12 comprises a housing 28 in which components of the surface-cleaning machine 10 are arranged in protected fashion.

In one exemplary embodiment, a hook device 30 is arranged on the rod 12 between the housing 28 and the handle 24, at which device an electrical cable can be fixed to the rod 22 by winding.

The surface-cleaning machine 10 comprises a suction apparatus device denoted as a whole by 32. Said suction apparatus device 32 serves for generating a suction flow for permitting a suction action at the cleaning roller 18.

The suction apparatus device 32 comprises a suction fan 34 which is arranged in the housing 28. The suction fan 34 in turn has a motor and in particular an electric motor 36, which is likewise arranged in the housing 28.

The suction apparatus device 32 is associated with a separator device 38. The latter separates solid from liquid constituents in a suction flow.

The separator device 38 is likewise arranged in the housing 28.

The separator device 38 is associated with a reservoir device 40 for dirty liquid. Said reservoir device is seated removably on the housing 28.

Furthermore, a reservoir device 42 for cleaning liquid is seated removably on the housing 28. The cleaning liquid is in particular water or a mixture of water and detergent.

The suction apparatus device 32 is fluidically connected to (at least) one suction duct 44 which is led from the suction fan 34 on the appliance body 12 through the housing 28 to the cleaning head 14. The suction duct 44 has a first region 46 which is positioned in the housing 28. In one exemplary embodiment, a branch 48 is seated in the housing 28 at the first region 46, which branch branches off to a second region 50 and a third region 52 of the suction duct 44. The first region 46 is thereby divided into two partial ducts. The second region 50 and the third region 52 are led in each case to the cleaning head 14.

The second region 50 and the third region 52 are in each case associated with a suction mouth 54 which is positioned on the cleaning head 14.

Figure 9:
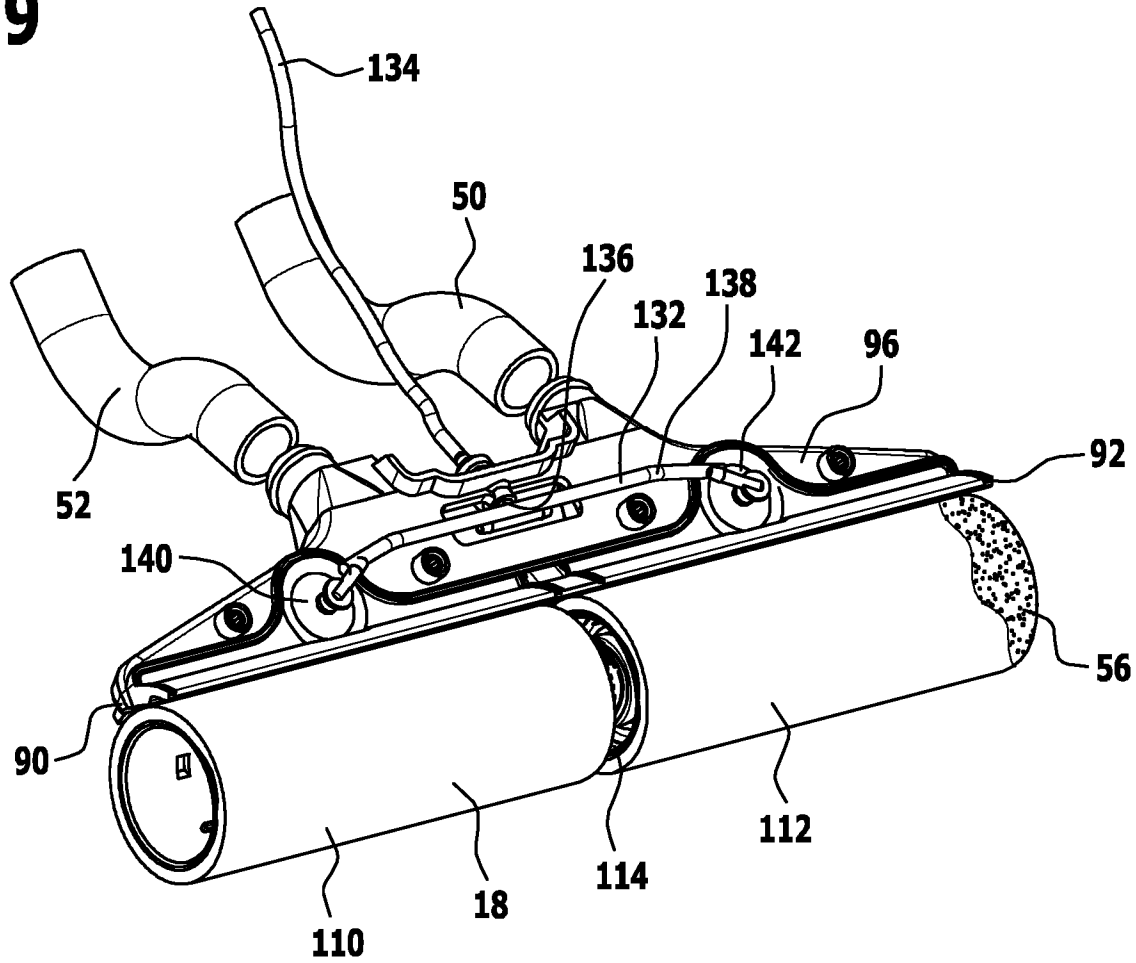
FIG. 9 shows a perspective partial view of a cleaning head of the surface-cleaning machine as per FIG. 1.

On the cleaning roller 18 there is arranged a jacket 56 (cf. FIG. 9). Said jacket is for example a nonwoven material.

Figure 5:
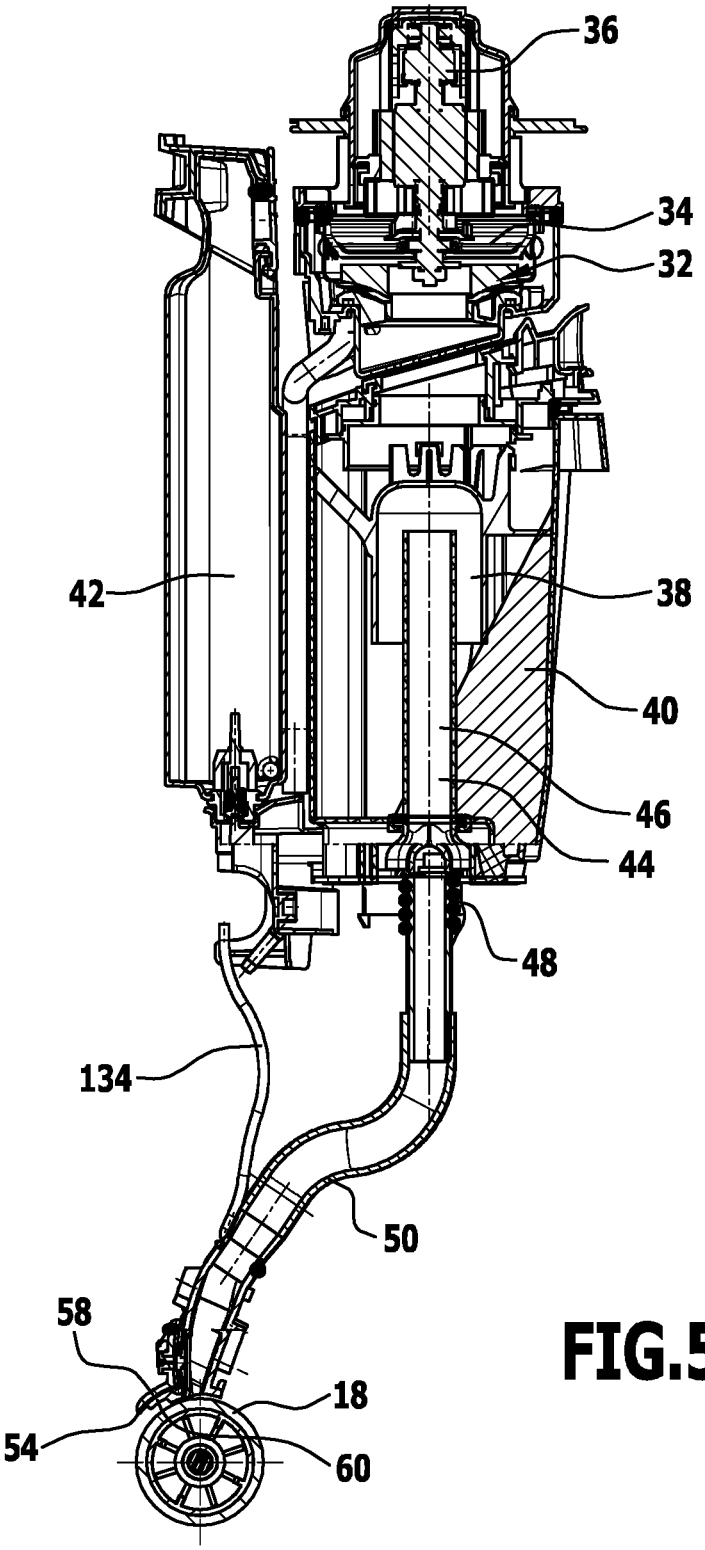
FIG. 5 shows a sectional view along the lines 5-5 as per FIG. 3.

In one exemplary embodiment, the suction mouth has a first mouth wall 58 and a second, spaced-apart mouth wall 60 (FIG. 5). The respective suction mouth 54 is formed between the first mouth wall 58 and the second mouth wall 60. The first mouth wall 58 is situated above the second mouth wall 60 when the cleaning roller 18 is set down on the surface for cleaning 16. The first mouth wall 58 and/or the second mouth wall 60 lie(s) against the jacket 56 of the cleaning roller 18 or project(s) into the jacket 56. A corresponding mouth construction is described in the international application PCT/EP2013/076445, of 12 Dec. 2013, from the same applicant, which does not constitute a prior publication. The full content of said document is expressly incorporated by reference.

Here, it is basically possible for the second region 50 and the third region 52 to be associated with its own suction mouth 54, or it is possible for a common suction mouth to be provided for the second region 50 and the third region 52 of the suction duct 62. Said single suction mouth 54 then has two suction points via the second region 50 and the third region 52.

It is basically possible for the suction apparatus device 32 to be formed without a branch, and to comprise multiple (in particular two) suction ducts (two first regions 46), which are arranged in the housing 28. Said suction ducts then continue into the second region 50 or the third region 52.

Figure 4:
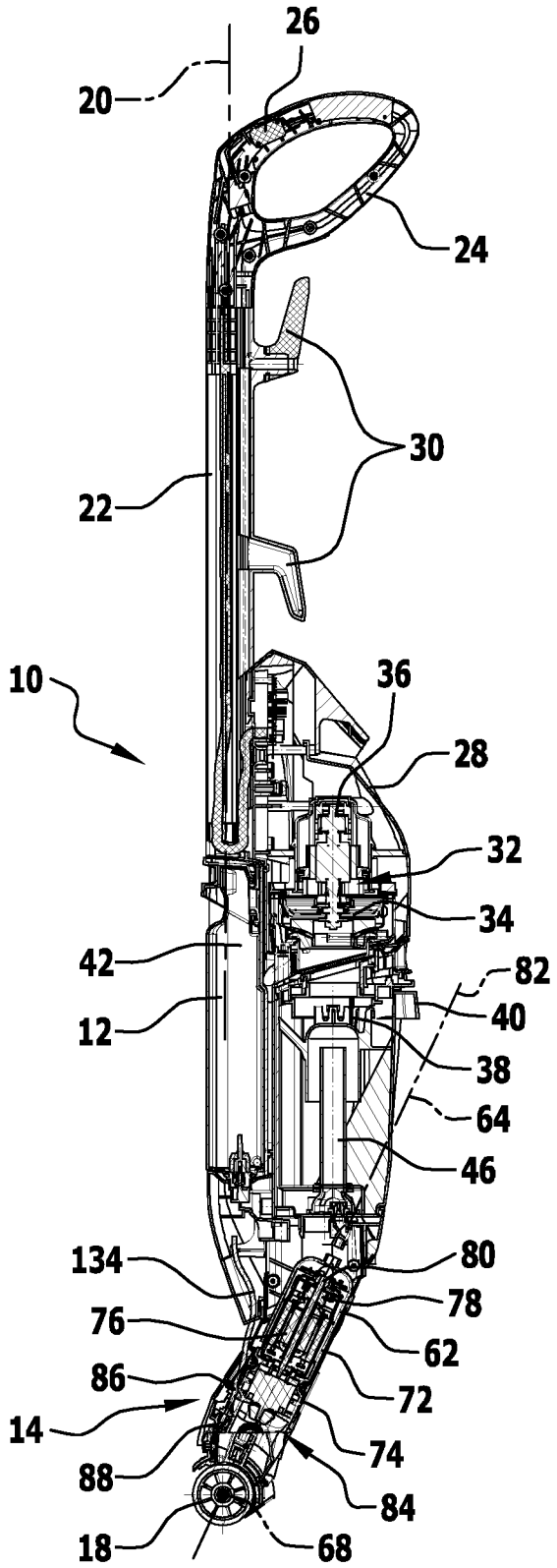
FIG. 4 shows a sectional view along the line 4-4 as per FIG. 3.

The cleaning head 14 is held by means of a joint 62, so as to be pivotable about a pivot axis 64, on the appliance body 12 (FIG. 2, FIG. 4). The pivot axis 64 lies transversely with respect to the longitudinal axis 20 of the appliance body 12. The pivot axis lies in particular at an acute angle 66 (FIG. 2) with respect to the longitudinal axis 20. The acute angle 66 lies in particular in the range between 15° and 35°. In one exemplary embodiment, the acute angle 66 is approximately 25°.

The pivot axis 64 lies transversely and in particular perpendicularly with respect to an axis of rotation 68 of the cleaning roller 18.

The cleaning roller 18 has a longitudinal axis 70. The longitudinal axis 70 is in particular coaxial with respect to the axis of rotation 68.

The pivot joint comprises an inner sleeve 72 (cf. for example FIG. 4) which, correspondingly to the orientation of the pivot axis 64, is arranged on the appliance body 12 at the acute angle 66 with respect to the longitudinal axis 20.

The cleaning head 14 has an outer sleeve 74 which is seated on the inner sleeve 72. A corresponding blocking device ensures that the outer sleeve 74 is not displaceable relative to the inner sleeve 72 in the direction of the pivot axis 64.

The inner sleeve 72 has a cylindrical outer contour. The outer sleeve 74 has a cylindrical inner contour. The joint 62 is formed as a sliding joint by means of the rotatable mounting of the outer sleeve 74 on the inner sleeve 72.

Pivotability through a full 360° angle may basically be provided. In one exemplary embodiment, the pivotability is restricted for example to a range of ±45° or ±90°.

A line for the regions 50, 52 between the appliance body 12 and the cleaning head 14 is correspondingly of elastic form in order to permit pivoting of the cleaning head 14 (in particular in a restricted pivoting range) at the joint 62.

For the rotational drive of the cleaning roller 18, a drive device 76 is provided. The drive device 76 comprises a drive motor 78. Said drive motor 78 is in particular an electric motor. The drive motor 78 is positioned in the inner sleeve 72 of the joint 62.

The drive motor 78 has a motor shaft 80. The motor shaft 80 has a drive axis 82. The drive axis 82 is parallel and in particular coaxial with respect to the pivot axis 64.

The drive motor 78 is seated fixedly in the inner sleeve 72 on the appliance body 12. Here, said drive motor is positioned at the transition from the appliance body 12 to the cleaning head 14, specifically at the joint 62. Here, the drive motor is accommodated in space-saving fashion and, in relation to a center of gravity of the surface-cleaning machine 10, is situated in the vicinity of the cleaning head 14.

The drive motor 78 is supplied with electrical energy for example by means of mains current.

The drive axis 82 of the drive motor 78 and the axis of rotation 68 of the cleaning roller 18 are oriented transversely to one another and in particular perpendicularly to one another. For transmission of torque from the drive device 76 to the cleaning roller 18, a transmission device 84 is provided. In one exemplary embodiment, the transmission device 84 comprises a rotational speed reducer 86. The rotational speed reducer 86 serves for reducing a rotational speed in relation to the rotational speed of the motor shaft 80. The drive motor 78 is in particular a standard electric motor which has for example a rotational speed in the range of 7000 revolutions per minute. The rotational speed reducer 86 realizes a rotational speed reduction to for example approximately 400 revolutions per minute.

The rotational speed reducer 86 is in particular arranged directly at the drive motor 78, that is to say is arranged immediately adjacent thereto. Here, said rotational speed reducer may also be arranged in the inner sleeve 72 or even on the cleaning head 14.

In one exemplary embodiment, the rotational speed reducer 86 is in the form of a planetary gear set.

The transmission device 84 furthermore has an angular gearing 88. Said angular gearing 88 realizes a redirection of torque in order to effect drive of the cleaning roller 18 with the axis of rotation 68 transverse with respect to the drive axis 82 of the drive motor 78. The angular gearing 88 is in particular positioned downstream of the rotational speed reducer 86.

In one exemplary embodiment, the angular gearing 88 has one or more gearwheels which are coupled rotationally conjointly to a corresponding shaft of the rotational speed reducer 86. Said gearwheels act on a bevel gear for angle conversion.

Figure 10:
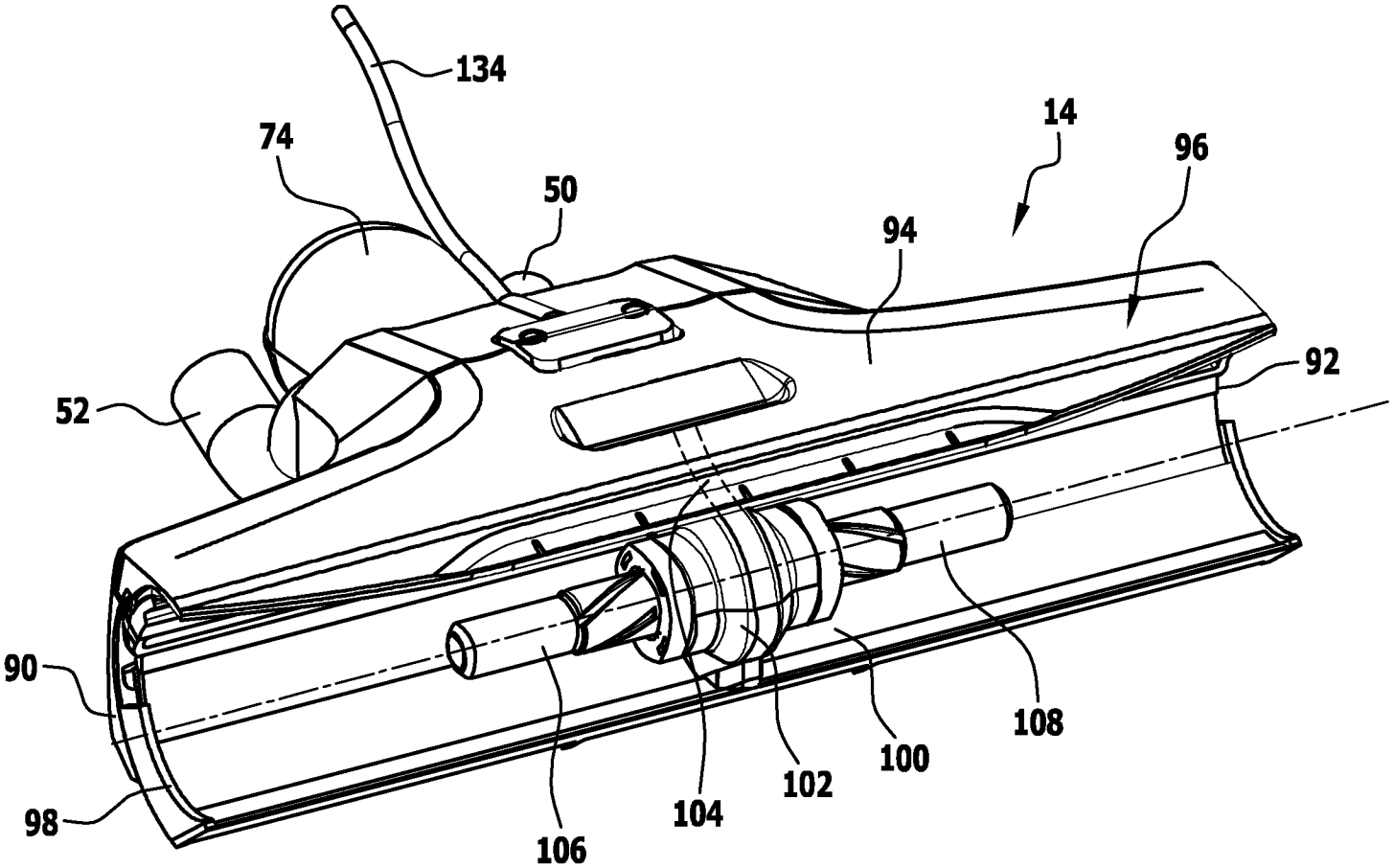
FIG. 10 shows a further view of the cleaning head without cleaning roller.

The cleaning head 14 has a first face side 90 and an oppositely situated second face side 92 (see for example FIG. 10). A housing 94 of a cleaning roller holder 96 extends between the first face side 90 and the second face side 92. Said housing 94 partly embraces, in the form of a half-shell, a cleaning roller 18 held on said housing, wherein the embracing is such that a significant part of the cleaning roller 18 projects out for a cleaning process.

In one exemplary embodiment, a sweeping element 98 is rotatably mounted on the housing 94 of the cleaning roller holder 96, wherein said sweeping element 98 serves for sweeping in coarse dirt in order for it to be entrained by the cleaning roller 18.

A cleaning head 14 with a corresponding sweeping element 98 is described in the German patent application no. 10 2014 114 776.6, of 13 Oct. 2014, from the same applicant. The entire content of said document is expressly incorporated by reference.

In a central region 100 of the cleaning roller holder 96 between the first face side 90 and the second face side 92, there is arranged a drive element 102. Said drive element 102 is connected in terms of torque transmission to the drive device 76.

In one exemplary embodiment, the drive element 102 is coupled in terms of torque transmission via a belt 104 to the angular gearing 88. The drive element 102 is spaced apart from the angular gearing 88. The belt 104 bridges said spacing and effects drive of the drive element with rotation about the axis of rotation 68.

A first pin 106 is arranged rotationally conjointly on the drive element 102 toward the first face side 90. A second pin 108 is arranged rotationally conjointly toward the second face side 92.

The cleaning roller 18 (for example FIG. 9) is of two-part form with a first part 110, which is seated rotationally conjointly on the first pin 106, and a second part 112, which is seated rotationally conjointly on the second pin 108. The first part 110 is directed toward the first face side 90. The second part 112 is directed toward the second face side 92.

A gap 114 is formed between the first part 110 and the second part 112. Said gap 114 is of relatively narrow form and has a width very much smaller than a length of the cleaning roller 18 along the longitudinal axis 20. The belt 104 is guided in the gap 114. Here, the belt 104 is recessed relative to an outer side of the cleaning roller 18 even in relation to a position in which the jacket 56 is compressed.

Figure 6:
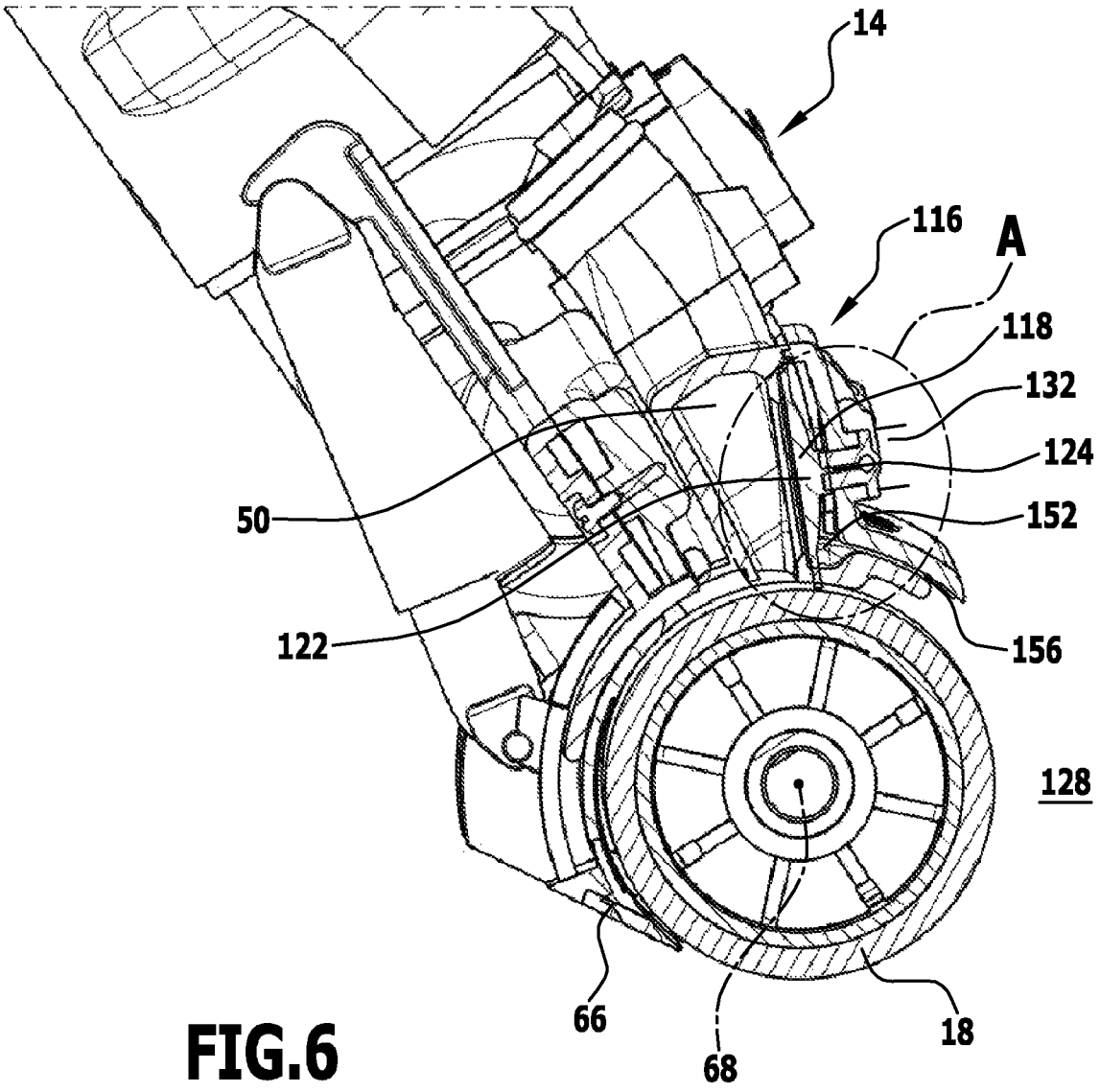
FIG. 6 is an enlarged illustration of a front region of a cleaning head of the surface-cleaning machine as per FIG. 1 in a lateral sectional view along the line 6-6 as per FIG. 3.
Figure 7:
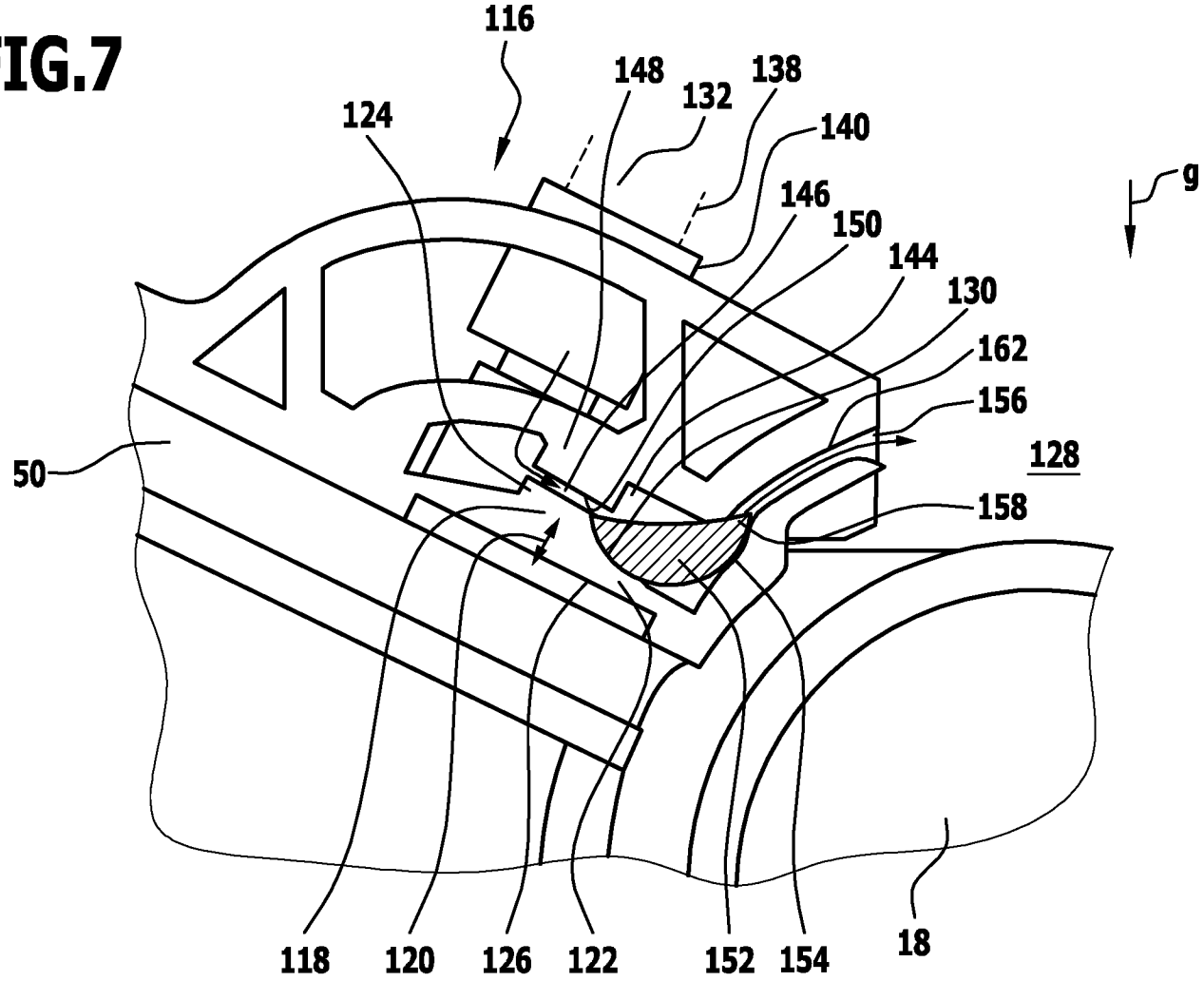
FIG. 7 is an enlarged illustration of the region A as per FIG. 6 in a first position.
Figure 8:
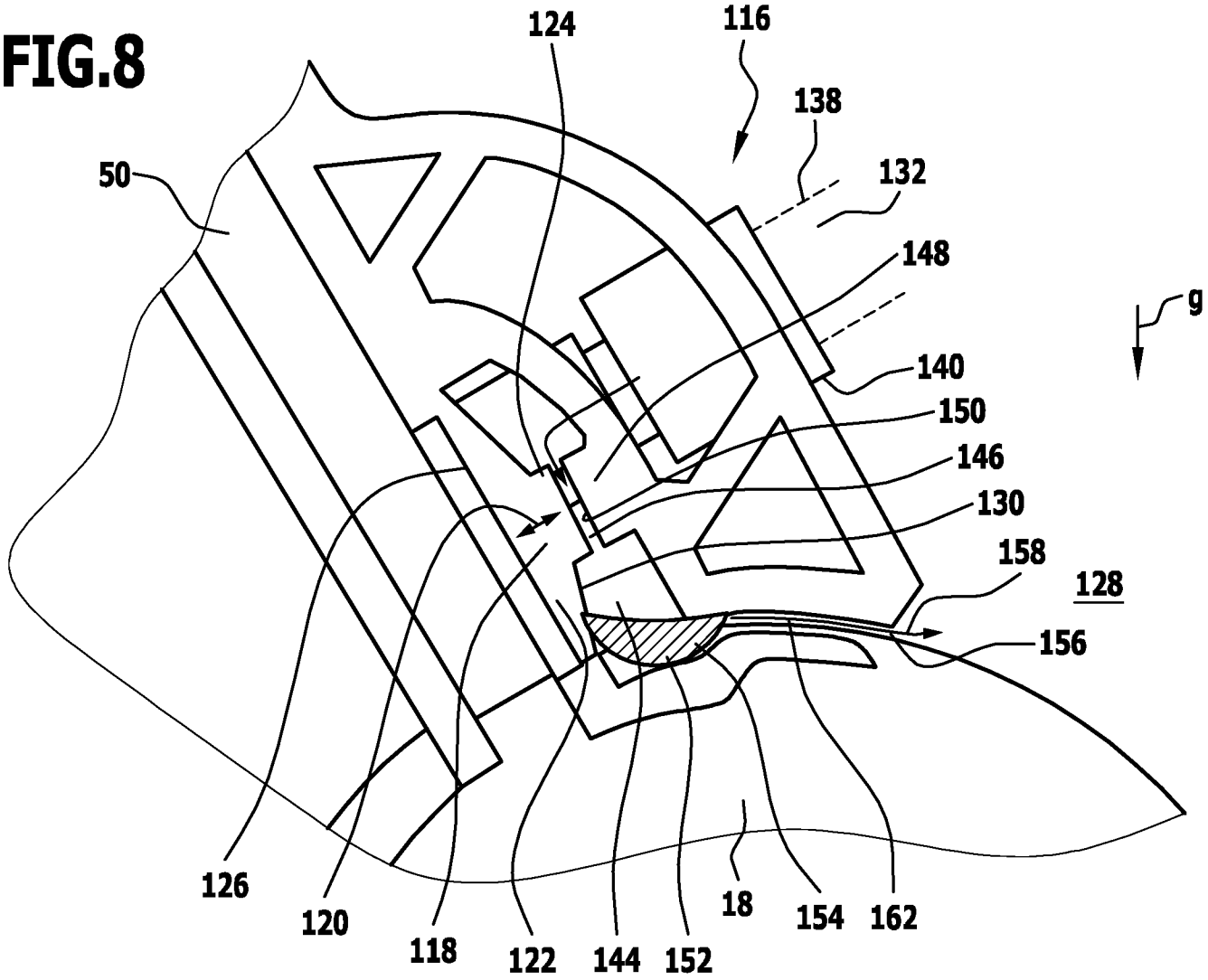
FIG. 8 is an illustration similar to FIG. 7 in another position in relation to the direction of gravity.

The surface-cleaning machine 10 comprises a wetting device 116 for the cleaning roller 18 (in particular FIGS. 6 to 8).

The wetting device comprises a (at least one) pressure-controlled switch 118. Said pressure-controlled switch 118 is movable. (In FIGS. 7 and 8, this is indicated by the double arrow 120). The pressure-controlled switch 118 comprises a movable membrane 122, on which a shut-off element 124 is seated, for example in one piece therewith. As a result of the moveability of the membrane 122, the shut-off element 124 is also movable. The membrane 122 has a first surface 126. Said first surface 126 is connected in terms of pressure to the suction duct 44 and, here, to the second region 50 and to the third region 52 respectively. The pressure prevailing in the second region 50 (and the third region 52, respectively) prevails at the first surface 126. During cleaning operation of the surface-cleaning machine 10, owing to the suction flow, said pressure is a negative pressure in relation to the outside space 128 outside the surface-cleaning machine 10.

Opposite the first surface 126, the membrane 122 has a second surface 130.

The membrane 22 is fluidically connected to a collecting space 132. The collecting space 132 can accommodate cleaning liquid.

The collecting space 132 is fluidically connected via a line 134 to the reservoir device 42 for cleaning liquid.

The line 134 is led from the reservoir device 42 through the appliance body 12 to the cleaning head 14. Said line is of flexible form such that it does not impede pivotability (in particular within a finite pivoting range) of the cleaning head 14 on the appliance body 12 about the joint 62.

In one exemplary embodiment (FIG. 9), a plurality of pressure-controlled switches 118 is arranged on the cleaning head 14.

In the exemplary embodiment shown, the cleaning head 14 has two pressure-controlled switches 118. In each case one pressure-controlled switch 18 is connected in terms of pressure to the second region 50, and a further pressure-controlled switch 18 is connected in terms of pressure to the third region 52.

At a connection 136 (which is in particular a T-piece), the line 134 leads into a distributor line 138. The distributor line 138 in turn opens into the housing 94 at a first connection point 140 and at a second connection point 142. In each case one associated pressure-controlled switch 118 is arranged downstream of the first connection point 140 and of the second connection point 142. The distributor line 138 forms the collecting space 132.

A shut-off valve 139 is arranged on the line 134 between the distributor line 138 and the reservoir device 42. Said shut-off valve is in particular manually actuable. By means of the shut-off valve 139, a fluidic connection between the reservoir device 42 and a fluid inlet of a pres sure-controlled switch 118 can be shut off.

It is basically also possible for more than two pressure-controlled switches 118 with corresponding connection points and collecting spaces to be provided, wherein one collecting space may also be associated with multiple switches 118, or it is possible for only a single pressure-controlled switch 118 with only one collecting space 132 to be provided.

In relation to a normal operating mode in which the cleaning roller 18 is supported on the surface for cleaning 16, an operator of the surface-cleaning machine 10 is standing on the surface for cleaning 16 and is holding the surface-cleaning machine by the handle 24, wherein the handle 24 is positioned above the surface for cleaning 16 in relation to the direction of gravitational force g, the reservoir device 42 for cleaning liquid is positioned above the cleaning head 14. In this way, cleaning liquid can be conveyed from the reservoir device 42 to the cleaning head 14 without the use of a pump, specifically in a manner driven by gravitational force (when the shut-off valve 139 is open).

In particular, the collecting space 132 is formed, in interaction with the pressure-control switch 118, such that cleaning liquid is always present in the collecting space 132 (when the shut-off valve 139 is open).

The second surface 130 faces into a chamber 144 which is connected in terms of pressure to the outside space 128.

An openable and closable fluid path 146 is formed between the collecting space 132 and the chamber 144. Depending on the position of the pressure-controlled switch 118, liquid can flow out of the collecting space 132 into the chamber 144. Depending on the position of the shut-off element 124, said fluid path 146 is shut off or open.

Depending on the pressure prevailing at the first surface 126, a pressure difference exists, or does not exist, between the second surface 130 and the first surface 126.

In an operating mode of the surface-cleaning machine in which the suction fan 34 is in operation, a negative pressure greater than a threshold value in relation to the outside space 128 prevails at the first surface 126. There is thus a significant pressure difference between the second surface 130 and the first surface 126.

Opposite the shut-off element 124 there is arranged a wall 148 which has an abutment surface 150 for the shut-off element 124.

If no pressure difference exists between the second surface 130 and the first surface 126, or the pressure difference threshold is not exceeded, then the shut-off element 124 abuts against the abutment surface 150, and the fluid path 146 is shut-off; the corresponding collecting space 132 and the chamber 144 are fluidically separated.

If a sufficient pressure difference exists between the second surface 130 and the first surface 126, the shut-off element 124 is raised away from the abutment surface 150, and the fluid path 146 is opened up. Cleaning liquid can flow into the chamber 144 from the collecting space 132 and thus from the reservoir device 42.

In a cleaning operating mode of the surface-cleaning machine 10 in which a suction flow exists in the suction duct 44 and thus also in the second region 50 and third region 52 respectively, a corresponding negative pressure load acts on the first surface 126, which negative pressure load causes the shut-off element 124 to be raised away from the abutment surface 150 and holds the shut-off element 124 in said raised-away position. The raised-away position is an open position of the pressure-controlled switch 118.

When the shut-off element 124 abuts against the abutment surface 150, a closed position of the pressure-controlled switch 118 exists, with the fluid path 146 being shut off.

The pressure-controlled switch 118 has a reset device which, if the pressure difference between the first surface 126 and the second surface 130 lies below the threshold value, effects a reset movement of the shut-off element 124 into the closed position, in which the shut-off element 124 is in contact with the abutment surface 150.

In an exemplary embodiment, the reset device is formed by means of the inherent elasticity of the membrane 122.

The transition from the open position into the closed position or vice versa of the pressure-controlled switch 118 is directly linked to the operation of the suction fan 34; the required negative pressure for moving and holding the membrane 122 in the open position is effected by the suction flow generated by the suction apparatus device 32.

The pressure-controlled switch 118, and in particular a multiplicity of pressure-controlled switches 118, is associated with a distributor 152. The distributor 152 serves for the distribution of cleaning liquid to the cleaning roller 18 and in particular for the application of liquid to said cleaning roller over the length of the cleaning roller 18.

In one exemplary embodiment, the distributor 152 is in the form of a channel 154. The channel 154 accommodates cleaning liquid up to a certain level. It can accumulate cleaning liquid.

The channel 154 extends parallel to the longitudinal axis 70 of the cleaning roller 18 and thus parallel to the axis of rotation 68.

Said channel is in particular arranged in the chamber 144.

Said channel extends in particular over a length which corresponds to the length of the cleaning roller 18 along the longitudinal axis 70, such that said cleaning roller can have cleaning liquid applied to it over its entire length.

The channel 154 is associated with an outlet opening device 156 which extends in particular over the entire length of the cleaning roller 18.

The channel 154 is of half-shell-like form. It thereby has, over its entire length, a discharge opening 158 for cleaning liquid.

The distributor 152 with the channel 154 can accumulate cleaning liquid. An intermediate buffer for cleaning liquid is thus formed. Cleaning liquid does not necessarily flow directly on the fluid path 146 to the cleaning roller 18 but is correspondingly collected in the channel 154.

Cleaning liquid is or is not capable of flowing out of the distributor 152 in a manner dependent on the position of the distributor 152 relative to the direction of gravitational force g, and thus in a manner dependent on the position and angular orientation of the longitudinal axis 20 of the surface-cleaning machine 10 relative to the surface for cleaning 16. An angular orientation of the surface-cleaning machine 10 relative to the surface for cleaning 16 is indicated in FIG. 1 by the reference numeral 160. Said angular orientation 160 may vary. The surface-cleaning machine 10 is supported by means of the cleaning roller 18 on the surface for cleaning 16. A setting-down region 162 of the cleaning roller 18 on the surface for cleaning 16 forms a pivot axis for a variation of the angular orientation 160.

The channel 154 is arranged such that, when a certain pivot angle of the angular orientation 160 is reached, cleaning liquid can flow out of the channel 154 directly to the cleaning roller 18 (FIG. 8).

FIG. 7 shows a position of the distributor 152 relative to the direction of gravitational force g in the case of which the outlet opening device 156 lies at a higher gravitational potential than the channel 154.

FIG. 8 shows a position in which the outlet opening device 156 lies at a lower gravitational potential than the channel 154.

In the latter case, cleaning liquid can flow directly out of the channel 154 to the cleaning roller 18 and apply cleaning liquid to the latter.

In this embodiment, the application of liquid to the cleaning roller 18 is controlled by gravity by way of the angular orientation 160. The angular orientation 160 is in turn adjusted by manual operation by the operator.

Detergent is or is not applied to the cleaning roller 18 in a manner dependent on whether a certain minimum pivot angle for the angular orientation 160 has been attained. This is defined by the vertical spacing, in the direction of gravitational force, between the outlet opening device 156 and the channel 154.

In an advantageous exemplary embodiment, one or more slot channels 162 are arranged between the one or more chambers 144 and the outlet opening device 156. Cleaning liquid from the channel 154 must, in order to be able to arrive at the cleaning roller 18, run through a corresponding slot channel 162.

A slot channel 160 is in particular formed with dimensions which yield a capillary effect for the flow of cleaning liquid. Such a capillary effect assists a uniform distribution of cleaning liquid over the entire length of the cleaning roller 18. In particular, the slot channel 162 extends substantially over the entire length of the cleaning roller 18.

A jacket 56 of the cleaning roller 18 abuts or almost abuts, by means of individual fibers, against the outlet opening device 156 of the slot channel 162 during the rotation of the cleaning roller 18. In this way, a (small) negative pressure is generated at the distributor 152, which negative pressure entrains cleaning liquid. Furthermore, cleaning liquid is drawn out of the slot channel 162 by the capillary effect of fibers of the jacket. This ensures uniform application of cleaning liquid to the cleaning roller 18.

The supply of cleaning liquid to the cleaning roller 18 is implemented without the use of pumps. The pressure-controlled switch 118 is coupled directly to a suction flow action of the suction fan 34. In this way, no additional control and in particular electronic control is required for moistening of the cleaning roller 18. In particular, no solenoid valves or the like are provided.

The surface-cleaning machine 10 according to the invention functions as follows:

For cleaning operation, the surface-cleaning machine 10 is supported by means of the cleaning roller 18 on the surface for cleaning 16. An operator stands on the surface for cleaning 16 behind the surface-cleaning machine 10, and holds the latter for example using one hand on the handle 24.

The operator can push the machine forward in the forward direction 164.

During cleaning operation, the suction fan 34 generates a suction flow which, in the suction duct 44 and thus in the regions 46, 50 and 52, gives rise to a negative pressure in relation to the outside space 128.

The drive motor 78 generates a torque which is transmitted via the transmission device 84 to the cleaning roller 18. The latter is driven in rotation. It is in particular driven in rotation counterclockwise (indicated in FIG. 1 by the reference numeral 166).

It is provided in particular that the cleaning roller 18 is driven with a circumferential speed in the range between 0.9 m/s and 1.2 m/s, and in particular with a circumferential speed of greater than 0.92 m/s and in particular less than 1.15 m/s.

It is driven for example with a circumferential speed in the range between 0.95 m/s and 1.05 m/s. For example, it is driven with a circumferential speed of approximately 1 m/s.

It may basically be provided that the circumferential speed can be adjusted by an operator. In a structurally simple embodiment, the drive device 76 defines a circumferential speed.

The cleaning roller 18 has a jacket 56 which is compressible. The jacket 56 is produced in particular from a textile material.

As mentioned above, the circumferential speed then relates not to a maximum diameter of the cleaning roller 18 but to a diameter when the jacket 56 is compressed for example by the force of the weight of the surface-cleaning machine 10.

An excessively low circumferential speed has the result that the surface-cleaning machine merely rolls on the surface for cleaning 16 without an adequate cleaning effect. An excessively high circumferential speed results in spraying of cleaning liquid.

Said circumferential speeds are in particular configured for a working speed (forward speed) of the operator of approximately 0.9 m/s.

The cleaning roller 18 is moistened with detergent from the reservoir device 42 by means of the wetting device 116. Said application of liquid is in this case realized without pumps, and in particular without solenoid valves. Under the action of gravitational force, cleaning liquid flows from the reservoir device 42 to the one or more collecting spaces 132. (In an embodiment in which the reservoir device is seated on the cleaning head, the reservoir device itself may form a collecting space.)

When the suction duct 44 with the regions 50, 52 is charged with negative pressure, the connection in terms of pressure to the one or more pressure-controlled switches 118 has the effect that the one or more fluid paths 146 are opened. It is then possible for cleaning liquid to accumulate in the distributor 152 and, from there, be applied to the cleaning roller 18. Here, provision is made for uniform application over substantially the entire length of the cleaning roller 18 along the longitudinal axis 70.

By way of capillary action by means of one or more slot channels 162, the uniform distribution can be assisted.

By (manually) shutting off the shut-off valve 139, cleaning operation without application of liquid ("suction operation") is possible.

By predefining the angular orientation 160, an operator can adjust whether or not cleaning liquid flows out of the distributor 152 to the cleaning roller 18. Said adjustment is controlled by gravitational force in accordance with whether the outlet opening device 156 is positioned above or below the channel 154 in relation to the direction of gravitational force, wherein capillary forces may possibly exist by means of the slot channel 162, and a negative pressure effect may exist as a result of abutment of fibers of the jacket 56 against the outlet opening device 156.

Using cleaning liquid, dirt on the surface for cleaning 16 is softened and can then be entrained by means of the cleaning roller 18.

Via the suction mouth 54 or corresponding suction mouths, sucking is realized by means of the suction flow that is generated. Separation into solid dirt particles and liquid occurs at the separator device 38. Dirty liquid is collected in the reservoir device 40.

By means of the joint 62, it is for example possible for the machine to be used to perform cleaning even in corners or at edges. The appliance body 12 is pivotable relative to the cleaning head 14 about the pivot axis 64 in the pivoting range.

The relatively heavy drive motor 78 is, in a normal operating mode, arranged low down in the vicinity of the cleaning head 14, and is positioned in space-saving fashion at least partially at the joint 62. Here, the drive motor may be positioned at least partially outside the cleaning head 14 (spaced apart from the cleaning roller 18).

Coarse dirt can be swept by means of the sweeping element 98, which coarse dirt can then be entrained by the cleaning roller 18.

LIST OF REFERENCE NUMERALS

10 Surface-cleaning machine
12 Appliance body
14 Cleaning head

16 Surface for cleaning
18 Cleaning roller
20 Longitudinal axis
22 Rod
24 Handle
26 Switch
28 Housing
30 Hook device
32 Suction apparatus device
34 Suction fan
36 Motor
38 Separator device
40 Reservoir device for dirty liquid
42 Reservoir device for cleaning liquid
44 Suction duct
46 First region
48 Branch
50 Second region
52 Third region
54 Suction mouth
56 Jacket
58 First mouth wall
60 Second mouth wall
62 Joint
64 Pivot axis
66 Acute angle
68 Axis of rotation
70 Longitudinal axis
72 Inner sleeve
74 Outer sleeve
76 Drive device
78 Drive motor
80 Motor shaft
82 Drive axis
84 Transmission device
86 Rotational speed reducer
88 Angular gearing
90 First face side
92 Second face side
94 Housing
96 Cleaning roller holder
98 Sweeping element
100 Central region
102 Drive element
104 Belt
106 First pin
108 Second pin
110 First part
112 Second part
114 Gap
116 Wetting device
118 Pressure-controlled switch
120 Double arrow
122 Membrane
124 Shut-off element
126 First surface
128 Outside space
130 Second surface
132 Collecting space
134 Line
136 Connection
138 Distributor line
139 Shut-off valve
140 First connection point
142 Second connection point
144 Chamber
146 Fluid path
148 Wall
150 Abutment surface
152 Distributor
154 Channel
156 Outlet opening device
158 Discharge opening
160 Angular orientation
162 Slot channel
164 Forward direction
166 Counterclockwise direction

The invention claimed is:

1. A surface-cleaning machine, comprising:

an appliance body on which a suction apparatus device is arranged;

a cleaning head on which at least one cleaning roller is arranged and on which there is positioned at least one suction mouth, which is fluidically connected to the suction apparatus device and is associated with the at least one cleaning roller; and a drive device for driving the at least one cleaning roller in rotation;

wherein a drive axis of a drive motor of the drive device and an axis of rotation of the at least one cleaning roller are oriented transversely with respect to one another; and wherein, during a cleaning operation, the surface-cleaning machine is supported on a surface for cleaning only by way of the at least one cleaning roller.

2. The surface-cleaning machine as claimed in claim 1, wherein the drive device comprises a transmission device for the transmission of torque to the at least one cleaning roller.

3. The surface-cleaning machine as claimed in claim 2, wherein the transmission device comprises a rotational speed reducer.

4. The surface-cleaning machine as claimed in claim 3, wherein the rotational speed reducer is or comprises a planetary gearing.

5. The surface-cleaning machine as claimed in claim 1, wherein the rotational speed reducer is arranged at the drive motor.

6. The surface-cleaning machine as claimed in claim 1, wherein the transmission device comprises an angular gearing.

7. The surface-cleaning machine as claimed in claim 6, wherein the angular gearing is or comprises a bevel-wheel gearing.

8. The surface-cleaning machine as claimed in claim 1, wherein the transmission device comprises a belt which drives a drive element on which the at least one cleaning roller is seated.

9. The surface-cleaning machine as claimed in claim 1, wherein the cleaning head is seated by means of a joint, so as to be pivotable about a pivot axis, on the appliance body.

10. The surface-cleaning machine as claimed in claim 9, wherein the pivot axis is oriented transversely with respect to a longitudinal axis of the appliance body, and in particular is oriented at an acute angle with respect to the longitudinal axis.

11. The surface-cleaning machine as claimed in claim 9, wherein the drive motor of the drive device is positioned at least partially on the joint.

12. The surface-cleaning machine as claimed in claim 11, wherein a drive axis of the drive motor lies at least approximately parallel or coaxially with respect to the pivot axis.

13. The surface-cleaning machine as claimed in claim 11, wherein the cleaning head is mounted so as to be rotatable about the drive motor.

14. The surface-cleaning machine as claimed in claim 9, wherein the joint has an inner sleeve, in which the drive motor is at least partially positioned, and an outer sleeve, which is seated on the inner sleeve and which is mounted pivotably thereon.

15. The surface-cleaning machine as claimed in claim 14, wherein the outer sleeve is fixed either to the appliance body or to the cleaning head, and wherein the inner sleeve is correspondingly fixed either to the cleaning head or to the appliance body.

16. The surface-cleaning machine as claimed in claim 1, wherein the cleaning head has a first face side and an oppositely situated second face side, wherein, in a central region between the first face side and the second face side, there is arranged a drive element which is connected in terms of torque transmission to the drive device.

17. The surface-cleaning machine as claimed in claim 16, wherein the at least one cleaning roller is of two-part form with a first part, which is seated on the drive element and is directed toward the first face side, and with a second part, which is seated on the drive element and is directed toward the second face side.

18. The surface-cleaning machine as claimed in claim 1, comprising a wetting device for moistening the at least one cleaning roller with cleaning liquid.

19. The surface-cleaning machine as claimed in claim 18, wherein a reservoir device for cleaning liquid is arranged on the appliance body.

20. The surface-cleaning machine as claimed in claim 1, wherein at least one of a receiving device for dirt and a reservoir device for dirty liquid is arranged on the appliance body.

21. The surface-cleaning machine as claimed in claim 1, wherein a separation device which is associated with the suction apparatus device is arranged on the appliance body.

22. The surface-cleaning machine as claimed in claim 1, wherein the at least one cleaning roller is driven at a circumferential speed in the range between 0.9 m/s (inclusive) and 1.2 m/s (inclusive).

23. The surface-cleaning machine as claimed in claim 22, wherein the at least one cleaning roller is driven at a circumferential speed in the range between 0.95 m/s (inclusive) and 1.05 m/s (inclusive).

* * * * *